US007213497B1

(12) United States Patent
Garcia et al.

(10) Patent No.: US 7,213,497 B1
(45) Date of Patent: May 8, 2007

(54) INFLATABLE TRAJECTORY ALTERING AND BLAST ENERGY ABSORPTION SYSTEM

(75) Inventors: Felipe Garcia, Panama City, FL (US); Robert Woodall, Panama City Beach, FL (US); Christopher Doyle, Panama City Beach, FL (US); Greg Reitmeyer, Pamana City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/274,708

(22) Filed: Nov. 14, 2005

Related U.S. Application Data

(62) Division of application No. 10/828,529, filed on Apr. 12, 2004.

(51) Int. Cl.
*F41H 5/02* (2006.01)

(52) U.S. Cl. ..... 89/36.02

(58) Field of Classification Search ..... 89/36.02, 89/36.17

See application file for complete search history.

(56) References Cited

U.S. PATENT DOCUMENTS

| | | | | |
|---|---|---|---|---|
| 1,788,335 | A * | 1/1931 | Lillian et al. | 152/340.1 |
| 3,205,106 | A * | 9/1965 | Cross | 156/79 |
| 3,864,206 | A * | 2/1975 | Linderoth | 162/103 |
| 4,501,035 | A * | 2/1985 | Hall et al. | 5/686 |
| 4,664,967 | A * | 5/1987 | Tasdemiroglu | 428/220 |
| 5,518,806 | A * | 5/1996 | Eder et al. | 428/218 |
| 5,601,258 | A * | 2/1997 | McClymonds | 244/171.7 |
| 6,520,491 | B2 * | 2/2003 | Timlick | 267/113 |

* cited by examiner

*Primary Examiner*—Stephen M. Johnson
(74) *Attorney, Agent, or Firm*—James T. Shepherd

(57) ABSTRACT

An inflatable trajectory altering and blast energy absorption system has a plenum with walls that are spaced apart from one another when the plenum is inflated. Flexible members, dispersed in the plenum and coupled thereto, are placed in tension when the plenum is inflated. Means for altering the trajectory of a projectile entering said plenum are dispersed within the plenum.

7 Claims, 2 Drawing Sheets

INFLATABLE TRAJECTORY ALTERING AND BLAST ENERGY ABSORPTION SYSTEM

CROSS-REFERENCE TO RELATED APPLICATIONS

This is a divisional application, claiming the benefit of parent application Ser. No. 10/828,529 filed on Apr. 12, 2004, the entire disclosure of which is incorporated hereby by reference.

STATEMENT OF GOVERNMENT INTEREST

The invention described herein may be manufactured and used by or for the Government of the United States of America for governmental purposes without the payment of any royalties thereon or therefor.

FIELD OF THE INVENTION

The invention relates generally to armor, and more particularly to an inflatable trajectory altering and blast energy absorption system that provides ballistic and blast protection.

BACKGROUND OF THE INVENTION

Armor is used in a variety of military applications for protection against ballistic projectile threats. The armor's ability to stop a projectile is a function of armor material toughness, hardness, energy absorbing impedance mismatch and material thickness. The distance between the point of initial impact on the outer armor surface to the innermost surface of the armor is also critical. In general, the greater this distance, the better the protection.

Current armor technology utilizes layers of hard materials interleaved with layers of resilient materials. For example, panels of metal or ceramic can be layered with a polymer and/or ceramic or other energy-absorbing, hard/tough materials (e.g., KEVLAR, SPECTRA, etc.). The general theory is that better protection is achieved using a greater number of layers. However, to protect against modern-day projectile technology, the thickness of the armor (i.e., number of armor layers) needs to be quite substantial in order to stop high-energy kinetic rounds. Protection against shaped charges also depends upon distance from the initial hard surface and the shaped charge's jet contact point with the armor's outer skin. The longer the stand-off, the greater the particulation of the shaped charge jet upon impact with the armor surface thus lessening its ability to penetrate by erosive process through the armor.

In the current art, the only methods used to increase ballistic protection involve (i) adding thick metal or ceramic plates or other hard materials, (ii) increasing the thread count of the ballistic fabric material (e.g., KEVLAR, SPECTRA, etc.) layers, (iii) increasing the number of layers of ballistic fabric and neoprene/polymer materials, and/or (iv) making spaced composite armor assemblies in which a plurality of plate armor with woven material composite assemblies are arranged in a spaced apart fashion. However, each of these methods increases the weight and cost of the armor.

SUMMARY OF THE INVENTION

Accordingly, it is an object of the present invention to provide a ballistic and blast protection system.

Another object of the present invention is to provide a lightweight protection system that offers ballistic and blast protection.

Other objects and advantages of the present invention will become more obvious hereinafter in the specification and drawings.

In accordance with the present invention, an inflatable trajectory altering and blast energy absorption system has a flexible and sealable plenum with opposing walls that are spaced apart from one another when the plenum is inflated. Dispersed in the plenum are tensioned lines and ballistic fabric sheets for altering trajectory of a projectile entering the plenum. The plenum's thickness helps absorb shock resulting from a blast event.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
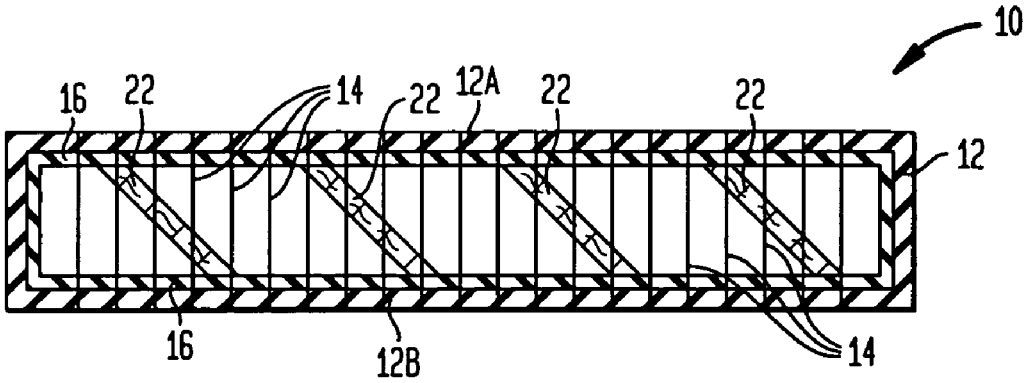
FIG. 1 is a cross-sectional view of one embodiment of an inflatable trajectory altering and blast energy absorption system in accordance with the present invention.

Referring now to the drawings, and more particularly to FIG. 1, one embodiment of an inflatable trajectory altering and blast energy absorption system of the present invention is shown in its inflated state and is referenced generally by numeral 10. System 10 has an outer wall structure 12 made from a flexible and fluid-impermeable material that defines a plenum. More specifically, wall structure 12 has major opposing walls 12A and 12B that are spaced apart from one another when the interior volume defined by wall structure 12 is inflated with a lightweight fluid such as air. The means used to inflate wall structure 12 can be any compressed air (or other fluid) inflation system and is not a limitation of the present invention. The inflation apparatus (not shown in FIG. 1) can be maintained therewith so that inflation of system 10 can occur just prior to use thereof. Alternatively, inflation of system 10 can be accomplished during the manufacture thereof. The material used for wall structure 12 can be selected from a wide variety of well known flexible and fluid-impermeable materials and is, therefore, not a limitation of the present invention.

In general, the trajectory altering and blast energy absorption system of the present invention includes a number of flexible members that are disposed within wall structure 12 and placed in tension after the inflation of wall structure 12. For the illustrated embodiment, flexible lines 14 are coupled to and span major opposing walls 12A and 12B such that lines 14 are placed in tension when wall structure 12 is inflated. Each of lines 14 can be made from a single fiber strand or multiple strands of fiber. In general, lines 14 should possess a high tensile strength and be abrasion resistant. Thus, a variety of polymer materials can be used for lines 14 with certain commercially-available products being preferred when system 10 is to be used to alter the trajectory of an incoming projectile. For example, lines 14 can be fibers made from the well-known polymeric strength materials SPECTRA available from Honeywell International Inc., KEVLAR available from E.I. du Pont de Nemours and Company, ZYLON available from Toyobo Company Ltd., TWARON available from Akzo Nobel, DYNEEMA available from Koninklijke DSM N.V., and nylon, just to name a few.

Attachment of lines 14 to major opposing walls 12A and 12B is preferably accomplished by a method known as "drop stitching" which maintains the sealed and fluid-impermeable integrity of wall structure 12. Drop stitching methods are known in the art of inflatable watercraft construction. See, for example, U.S. Pat. No. 6,074,261, the contents of which are hereby incorporated by reference. The lengths of lines 14 can be varied to shape the outer contours of wall structure 12 for a particular application.

The interior surfaces of wall structure 12 can be optionally coated or covered with a viscous polymeric sealing material layer 16 that serves to seal itself in the event of a small puncture. Examples of such sealing material constructions are disclosed in U.S. Pat. Nos. 4,501,035 and 5,295,525, the contents of which are hereby incorporated by reference.

In addition to lines 14, a plurality of ballistic armor fabric sheets 22 are arranged within wall structure 12 in a spaced-apart and substantially parallel fashion to form an angular relationship with lines 14 when lines 14 are in tension, i.e., when wall structure 12 is inflated. Inflation of wall structure 12 also places sheets 22 in tension. As used herein, the term "ballistic armor fabric sheet" refers to any flexible but high-strength fabric that is accepted as having ballistic protection properties in the field of ballistic protection systems. Currently, such fabrics include the previously-mentioned SPECTRA, KEVLAR, TWARON and DYNEEMA. However, it is to be understood that the present invention could utilize other ballistic armor fabric sheets as such are developed.

Ends of sheets 22 can be coupled to wall structure 12 in a variety of ways. For example, the ends of sheets 22 can be adhered to wall structure 12 with an adhesive and then stitched in place when lines 14 are stitched in. Lines 14 are passed through sheets 22 during the stitching process.

Figure 2:
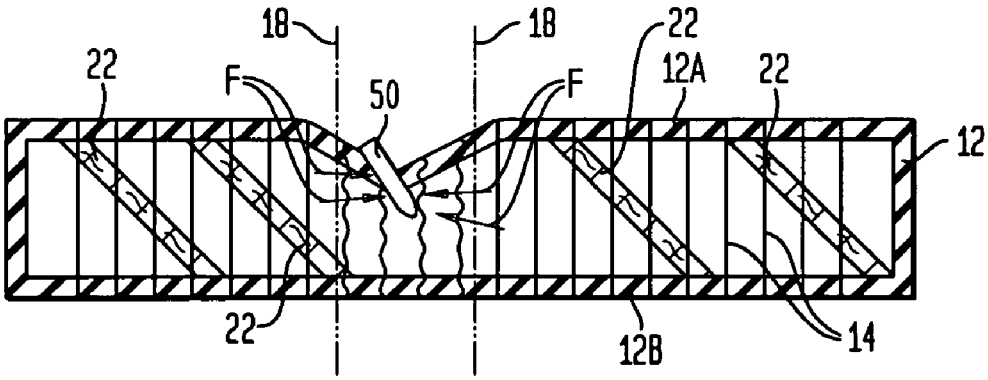
FIG. 2 depicts a view of the trajectory altering and blast energy absorption system of FIG. 1 immediately after a projectile has punctured one wall thereof.

The mechanisms by which system 10 alters a projectile's trajectory will now be described with the aid of FIG. 2 where a projectile 50 is shown after it pierces major wall 12A but before it reaches major wall 12B. For clarity of illustration, polymeric sealing material 16 has been omitted from FIG. 2 and each of the other illustrated embodiments of the present invention that will be discussed later herein. Those of lines 14 that are in line with or immediately adjacent to the point of impact of projectile 50 tend to break or relax (within the region between dashed lines 18). However, due to the inflation of wall structure 12, those of lines 14 surrounding relaxed region 18 experience a greater amount of tension as they are drawn towards region 18 and projectile 50. As a result, forces F are applied to projectile 50 from circumferential points thereabout.

The action of circumferential forces F tends to alter the trajectory of projectile 50 thereby causing projectile 50 to encounter more of lines 14. That is, forces F cause projectile 50 to experience yaw with respect to its original straightline course thereby making projectile 50 collide with more of lines 14. Simultaneously, the change in projectile trajectory increases the projectile's force bearing area which reduces the projectile's localized pressure point to immediately reduce the projectile's penetration capability. Thus, more collisions translate to more projectile course alterations and increased projectile bearing area resulting in increased energy losses.

Trajectory alteration also dissipates large amounts of the projectile's kinetic energy in lines 14 as the larger projectile bearing area impinges on lines 14. In addition, the subsequent movement of the impacted wall(s) absorb kinetic energy in a way not conducive to penetration thereby slowing the speed of projectile 50 and reducing its lethality.

The presence of sheets 22 aids in altering a projectile's trajectory and absorbs energy from the projectile. Specifically, when an incoming projectile impinges on a sheet 22, the sheet deflects to absorb energy and defines an angular path for the projectile to follow. If/when a projectile passes through one of sheets 22, the projectile encounters more of lines 14 and/or another sheet 22 where its trajectory is again altered and its energy is absorbed.

In addition, the present invention mitigates the shock wave resulting from a blast event. For many battlefield situations, this type of shock wave typically lasts for less than 30 milliseconds. The impedance mismatch between major walls 12A and 12B combined with the ability of the plenum to deform upon shock wave arrival reduces the intensity of these short-lived blast-induced shock waves impinging on the wall structure. More specifically, the impedance mismatch and flexible plenum make the present invention respond to a short-lived shock wave in a non-frangible and flexible way. As a result, a short-lived blast-induced shock wave can be absorbed during its brief period of lethality. Still further, the two spaced apart walls of wall structure 12 will aid in the jet particulation of an exploded shaped charge warhead.

Figure 3:
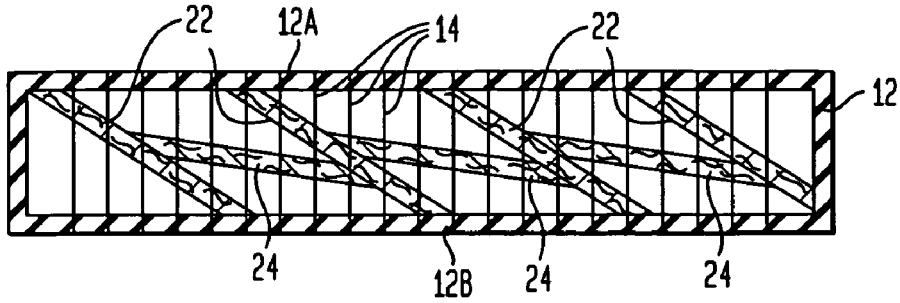
FIG. 3 is a cross-sectional view of another embodiment of the inflatable trajectory altering and blast energy absorption system that includes the use of a matrix of ballistic armor fabric sheets.
Figure 4:
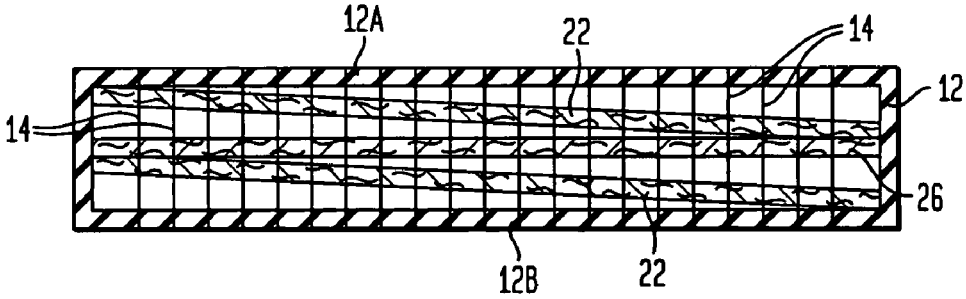
FIG. 4 is a cross-sectional view of another embodiment of the inflatable trajectory altering and blast energy absorption system that includes the use of a matrix of ballistic armor fabric sheets.

Another embodiment of the present invention is shown in FIG. 3 where sheets 22 are tethered to one another by ballistic armor fabric sheets 24 that are angularly disposed with respect to lines 14 and sheets 22. As a result, sheets 22 and 24 form a matrix of sheets that lie on different angles for trajectory alteration. FIG. 4 depicts a similar concept with sheets 26 (only one sheet 26 is shown for clarity of illustration) being interspersed with sheets 22 and substantially parallel to major opposing walls 12A and 12B.

Figure 5:
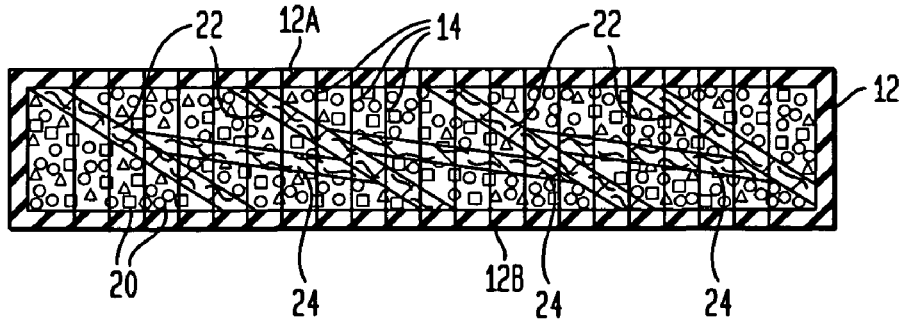
FIG. 5 is a cross-sectional view of another embodiment of the inflatable trajectory altering and blast energy absorption system that includes the use of shaped objects and a matrix of ballistic armor fabric sheets.

Projectile trajectory alteration and energy absorbing capabilities can be further enhanced by adding other material structures within wall structure 12. For example, each of the previously-described embodiments could further include shaped objects partially or completely filling the interior of the wall structure. FIG. 5 illustrates the FIG. 3 embodiment and further includes shaped objects 20 within wall structure 12. More specifically, a plurality of small lightweight shaped objects 20 can partially or completely fill wall structure 12. Objects 20 can be solid or hollow, and can be made from a hard lightweight material such as a ceramic material. Objects 20 can be shaped as spheres, cubes, pyramids, irregular shapes, or mixtures thereof, without departing from the scope of the present invention. For example, it is known that bi-modal distribution of small and large particles allows for more particles to be packed into a small volume thereby increasing resistance to penetration by a projectile. Thus, in general, the presence of objects 20 increases the amount of material available to absorb a projectile's energy and increases the surface area of the projectile due to mechanical damage as its trajectory is altered within wall structure 12. Note that another embodiment could make use of a wall structure 12 partially or completely filled with objects 20 without the use of any lines 14.

The advantages of the present invention are numerous. The inflatable system provides ballistic protection as the tensioned flexible members (e.g., lines and fabric sheets) dispersed an inflated plenum serve to alter an incoming projectile's trajectory while simultaneously absorbing the kinetic energy thereof. In addition, the inflatable system's two spaced apart major walls mitigate shock resulting from a blast event. The system is collapsible and lightweight, and can be adapted to conform to any shape/size.

The present invention provides the means to build an armor panel of great thickness and low weight. Armor thickness is of great importance as it is the only means available to overcome the basic thermodynamic limitation imposed by the fact that it takes time to transfer/absorb energy/work. Thus, a thicker armor provides the time necessary to effect energy transfer/absorption of a projectile or blast energy.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A trajectory altering and blast energy absorption system, comprising:

a flexible and sealable plenum having opposing walls that are spaced apart from one another when said plenum is inflated;

a fluid for inflating said plenum; and means, dispersed in said plenum, for altering trajectory of a projectile entering said plenum so-inflated with said fluid, said means comprising a plurality of flexible lines coupled to said walls of said plenum, said plurality of flexible lines being placed in tension when said plenum is inflated with said fluid, a plurality of ballistic armor fabric sheets in said plenum with said plurality of flexible lines passing therethrough, and a plurality of shaped objects in said plenum.

2. A trajectory altering and blast energy absorption system as in claim 1 wherein each of said plurality of shaped objects comprises a ceramic object.

3. A trajectory altering and blast energy absorption system as in claim 1 wherein said plurality of ballistic armor fabric sheets are disposed at a plurality of angles relative to said walls of said plenum.

4. A trajectory altering and blast energy absorption system as in claim 1 wherein each of said plurality of flexible lines comprises at least one fiber.

5. A trajectory altering and blast energy absorption system as in claim 1 further comprising a polymeric sealing material coupled to each of said walls of said plenum for sealing punctures therein.

6. A trajectory altering and blast energy absorption system as in claim 1 wherein said fluid is air.

7. A trajectory altering and blast energy absorption system as in claim 1 wherein said plurality of shaped objects is selected from the group consisting of spheres, cubes, pyramids, irregular shapes, and mixtures thereof.

* * * * *